US007292194B2

(12) United States Patent
Tai et al.

(10) Patent No.: US 7,292,194 B2
(45) Date of Patent: Nov. 6, 2007

(54) INVERTED-F ANTENNA AND METHOD OF MODULATING IMPEDANCE OF THE SAME

(75) Inventors: Lung-Sheng Tai, Tu-Cheng (TW); Po-Kang Ku, Tu-Cheng (TW); Shu-Yean Wang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/487,867

(22) Filed: Jul. 17, 2006

(65) Prior Publication Data

US 2007/0075902 A1 Apr. 5, 2007

(30) Foreign Application Priority Data

Jul. 15, 2005 (TW) ..... 94124101 A

(51) Int. Cl.
*H01Q 1/24* (2006.01)

(52) U.S. Cl. ..... 343/702; 343/860; 343/846

(58) Field of Classification Search ..... 343/702, 343/700 MS, 846, 860
See application file for complete search history.

(56) References Cited

U.S. PATENT DOCUMENTS 6,861,986 B2 * 3/2005 Fang et al. ..... 343/700 MS
7,034,754 B2 * 4/2006 Hung et al. ..... 343/700 MS
2005/0073462 A1 * 4/2005 Lin et al. ..... 343/702

* cited by examiner

*Primary Examiner*—Hoang V. Nguyen
(74) *Attorney, Agent, or Firm*—Wei Te Chung

(57) ABSTRACT

An inverted-F antenna (1) used in a portable electrical device formed in a metal patch and includes a radiating element (2), a grounding element (5), and an impedance matching element (3) with an impedance matching space (8). The impedance matching element (3) connects the radiating element (2) and the grounding element (5). A metal foil (7) locates in the impedance matching space and connects to the impedance matching element (3) for modulating impedance matching of the inverted-F antenna. A feeding line (4) includes an inner conductor (40) soldered with the impedance element (3) and a braiding layer (41) soldered with the grounding element (5).

20 Claims, 3 Drawing Sheets

INVERTED-F ANTENNA AND METHOD OF MODULATING IMPEDANCE OF THE SAME

BACKGROUND OF THE INVENTION

1. Field of the Invention

The present invention relates generally to an antenna, and more particularly to an inverted-F antenna used in a portable electronic device.

2. Description of the Prior Art

With the development of wireless communication, more and more portable electronic devices, for example notebook, install an antenna system for working in a Wireless Local-area Network (WLAN). Transmitting and receiving signals plays an important role in wireless communication process. In recent years, a majority of WLAN base on Bluetooth technical standard or 802.11 technical standard. Antenna according to Bluetooth technical standard is based on 2.4 GHz frequency band, and according to 802.11 technical standard is based on 2.4 GHz and 5 GHz. So, antennas in notebook mostly work in the above frequency bands at the present time.

However, an antenna used in a notebook or other portable electronic devices is very prone to be affected by environment. Same antenna used in different notebooks or other portable electric devices may have different performance function and effect because of the different environments. So, an antenna may work well in one notebook but cannot work well in another notebook unless necessary modulations are made to the antenna.

Usually, manufacture can alter length and breadth of radiating portion of an antenna made from a metal patch or make little change in impedance matching portion to suit different portable electric devices. However, such settlement means increases complex degree of making an antenna and goes against industrialization manufacture.

Hence, in this art, an inverted-F antenna to overcome the above-mentioned disadvantages of the prior art will be described in detail in the following embodiment.

BRIEF SUMMARY OF THE INVENTION

A primary object, therefore, of the present invention is to provide an antenna assembly which is capable of modulating impedance.

A second object, therefore, of the present invention is to provide a method of modulating impedance of above antenna.

In order to implement the above object and overcomes the above-identified deficiencies in the prior art, an inverted-F antenna in accordance with the present invention forming in a metal patch, comprises a radiating element, a grounding element, and a impedance matching element with a impedance matching space. The impedance matching element connects the radiating element and the grounding element. A metal foil locates in the impedance matching space and connects to the impedance matching element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 3:
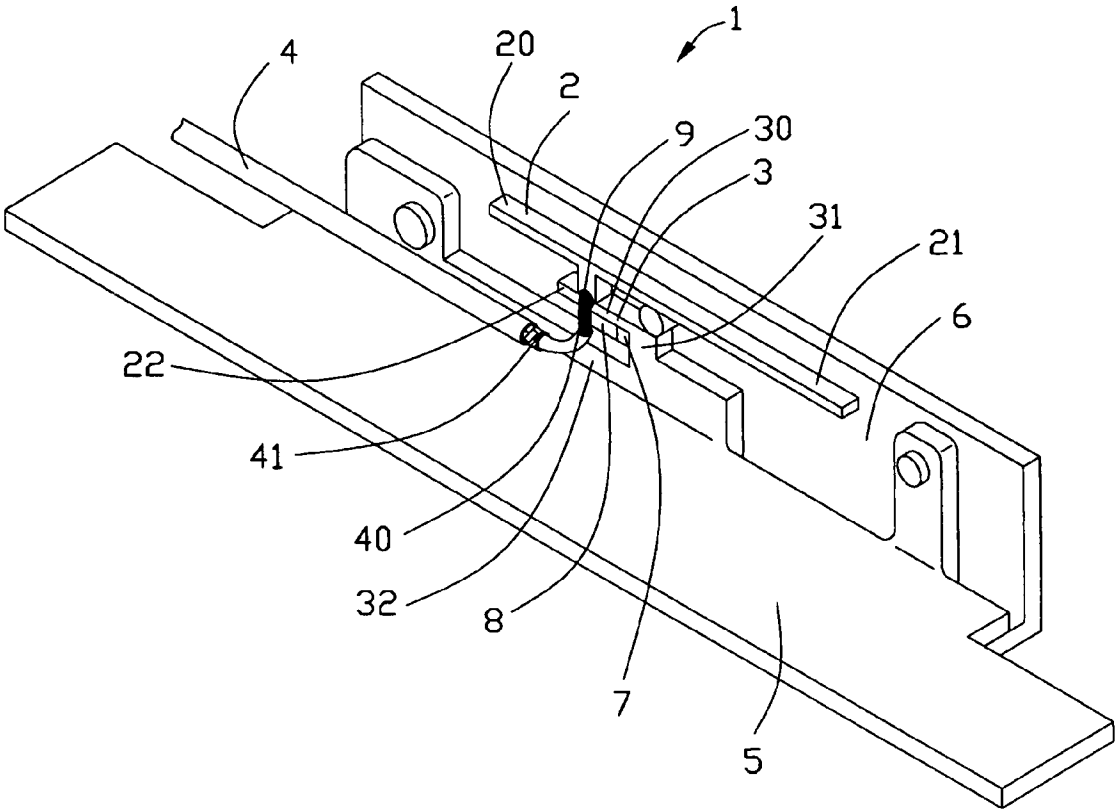
FIG. 3 is a perspective view of the inverted-F antenna fixed on a shell in accordance with the present invention.

Referring to FIG. 3, an antenna assembly 1 of the present invention comprises an antenna 11 comprising a radiating element 2, a grounding element 5, a feeding line 4, and an impedance matching element 3 connecting the radiating element 2 to the grounding element 5, a metal shell 6, and a metal foil 7 fixed on the metal shell 6.

Figure 1:
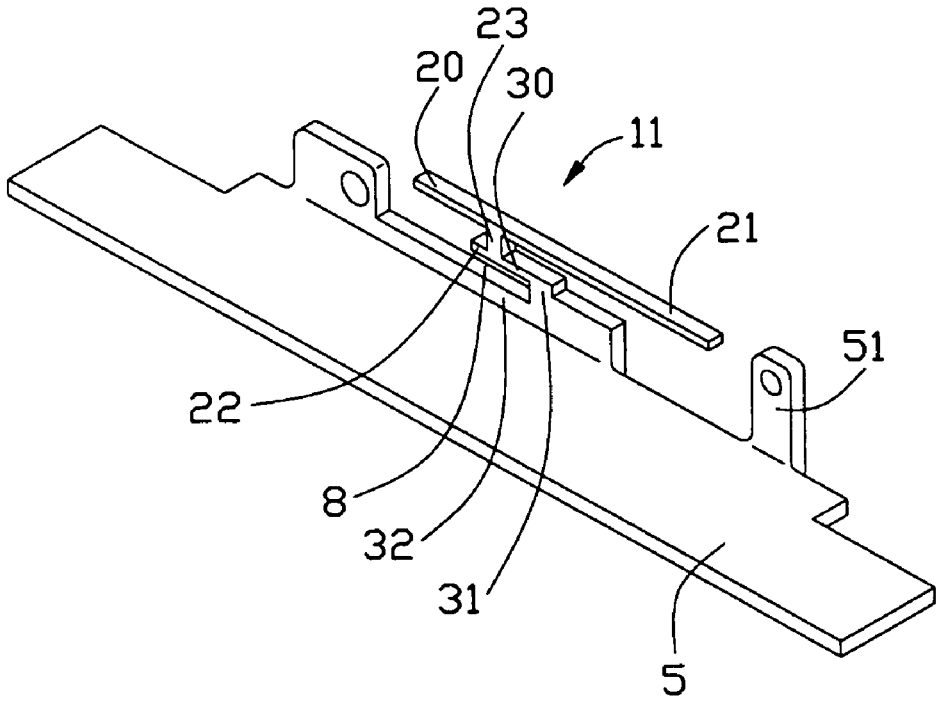
FIG. 1 is a perspective view of an inverted-F antenna in accordance with the present invention.
Figure 2:
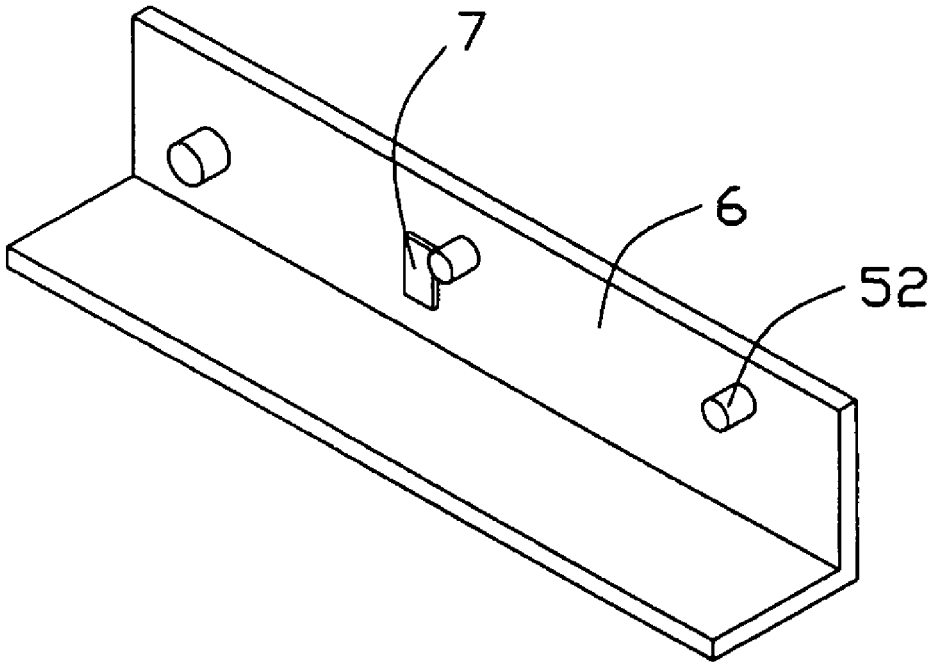
FIG. 2 is a perspective view of a metal foil fixed on an inverted-F antenna shell accordance with the present invention.

Referring to FIGS. 1-3, the antenna 11 is of inverted-F type for a notebook. The antenna 11 is made from a metal bracket of notebook or formed by digging slots (no labeled) in the same metal patch.

The radiating element 2 comprises a first radiating section 20 extending in a longitudinal direction, a second radiating section 21 extending in a direction opposite to that of the first radiating section 20, and a third radiating section 22 arranged below the first, second radiating section 20, 21 with parallel relationship to the first and second radiating sections 20, 21. The first radiating section 20 and the second radiating section 21 are connected at a first site (no labeled). The third radiating section 22 connects to the impedance matching element 3 at a second site 9. An upright bar 23 extending from the first site to the second site 9 connects the first, second, and third radiating sections 20, 21, and 22. The impedance matching element 3 comprises a first connecting section 30, a third connecting section 32 parallel to the first connecting section 30, and a vertical second connecting section 31 connecting the first connecting section 30 and the third connecting section 32. The first connecting section 30, the second connecting section 31, and the third connecting section 32 together formed an impedance matching space 8. The impedance matching element 3 shows a lying U shape. The third radiating section 22 extends away from the left end of the first connecting section 30.

The grounding element 5 extends from the third connecting section 32 and locates in a plane perpendicular to the plane in which the impedance matching element 3 and the radiating element 2 locate. The grounding element 5 has a pair of installing sections 51 each comprising a hole and respectively extending perpendicularly from an edge of the grounding element 5 into the plane of the impedance matching element 3 and the radiating element 2.

Referring to FIGS. 2 and 3, the metal shell 6 showing a L-shape comprises three posts 52 spaced arranged on a vertical section thereof. Two posts 52 protrude through the two holes of the installing sections 51 for installing the antenna 11 on the metal shell 6. The middle post 52 protrudes through the space formed between the second radiating section 20 and the first connecting section 30 for supporting the radiating element 2.

The feeding line 4 comprises an inner conductor 40 electrically connecting to the radiating element 2 and a metal braiding layer 41 electrically connecting to the grounding element 5. The inner conductor 40 is soldered at the second site 9 which is served as the feeding point. The metal shell 6 is of L-shape comprising a vertical section attached to the radiating element 2 and matching element 3 and a horizontal section attached to the grounding element 5.

The first radiating section 20, the third radiating section 22, the impedance matching element 3, the grounding element 5, and the feeding line 4 together form a first inverted-F antenna 11 receiving and transmitting high frequency signals (4.9-5.35 GHz, 5.47-5.87 GHz). The second radiating section 21, the impedance matching element 3, the grounding element 5, and the feeding line 4 together form a second inverted-F antenna 11 receiving and transmitting lower frequency signals (2.4 GHz-2.5 GHz).

The metal foil 7 is attached to the vertical section of the metal shell 6 of the antenna assembly 1 and is located adjacent to the middle post 52, such arrangement of the metal foil 7 aids to be corresponding to the impedance matching space 8 of the antenna 11. The impedance matching element 3 contacts with the metal foil 7 when install the antenna 11 on the metal shell 6. According to different environments of different notebooks, user just needs to choose a suitable metal foil 7 matching the input impedance of the antenna 11. In the preferred embodiment of the present invention, the metal foil 7 is an aluminum foil, but in alternative embodiments, the metal foil 7 is also made from other materials, such as copper foil. In addition, the metal shell 6 maybe a part of a notebook, or a separate member attached with the metal foil 7 to be settled in the notebook.

The method of modulating the impedance of the antenna 11 of the present invention comprises following steps. The first step is to choose a rectangle metal piece. The second step is to calculate qualified lengths of the first radiating section 20, the second radiating section 21, and the third radiating section 22. The third step is to calculate and confirm a length and shape of the impedance matching element 3. The fourth step is to achieve the radiating element 2, the impedance matching element 3 having impedance matching space 8, and the grounding element 5 by digging slots in the rectangle metal piece according to said calculations. The fifth step is to decide the location of the feeding point 9 and provide the feeding line 4 connecting to the second site 9. The sixth step is to choose a metal shell 6 and a metal foil 7 attached to the location of the metal shell 6 corresponding to the impedance matching space 8. The seventh step is to install the antenna 11 on the shell 6 and make the impedance matching element 3 contacting with the metal foil 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inverted-F antenna used in an electronic device, comprising:

a radiating element comprising a first radiating section;

a grounding element;

an impedance matching element connecting the radiating element and the grounding element;

a metal foil contacting with the impedance matching element for modulating the impedance matching of the antenna; and a feeding line comprising an inner conductor electrically connecting to the impedance matching element and a braiding layer electrically connecting to the grounding element.

2. The inverted-F antenna as claimed in claim 1, further comprising a shell installed with said antenna, and wherein said metal foil is attached to the shell corresponding to the impedance matching element.

3. The inverted-F antenna as claimed in claim 2, wherein the radiating element comprises the first radiating section extending in a longitudinal direction, a second radiating section extending in an opposite direction from the first radiating section, and a third radiating section, and wherein the first radiating section and the second radiating section are connected at a first site, the third radiating section connects to the impedance matching element at a second site.

4. The inverted-F antenna as claimed in claim 3, wherein the first connecting section, the second connecting section, and the third connecting section together form an impedance matching space.

5. The inverted-F antenna as claimed in claim 3, wherein the impedance matching element is of a lying U shape.

6. The inverted-F antenna as claimed in claim 1, wherein the impedance matching element and the radiating element locate in the same plane.

7. The inverted-F antenna as claimed in claim 1, wherein the grounding element is mainly located in a plane perpendicular to that of the radiating element and the impedance matching element.

8. The inverted-F antenna as claimed in claim 7, wherein the grounding element has a pair of installing sections each comprising a hole and respectively extending perpendicularly from an edge of the grounding element into the plane of the impedance matching element and the radiating element.

9. The inverted-F antenna as claimed in claim 8, wherein the shell showing a L-shape comprises three posts spaced arranged on a vertical section thereof, two posts protrude through the two holes of the installing sections for installing the antenna on the metal shell, the middle post protrudes through the space formed between the second radiating section and the first connecting section for supporting the radiating element.

10. The inverted-F antenna as claimed in claim 9, wherein the impedance matching element comprises a first connecting section connecting to the second site, a third connecting section connecting to the grounding element and parallel to the first connecting section, and a second connecting section connecting the first connecting section and the third connecting section.

11. The inverted-F antenna as claimed in claim 10, wherein the metal foil is located to the impedance matching space.

12. The inverted-F antenna as claimed in claim 9, wherein the feeding line is soldered at the second site.

13. The inverted-F antenna as claimed in claim 8, wherein an upright bar extending from the first site to the second site connects the first, second, and third radiating sections.

14. A method of modulating impedance matching of an inverted-F antenna comprising following steps of:

a) choosing a rectangle metal piece;

b) calculating a required length of a radiating element of the inverted-F antenna;

c) calculating a length and shape of an impedance matching element of the inverted-F antenna;

d) achieving the radiating element, the impedance matching element having impedance matching space, and a grounding portion by digging slots in the rectangle metal piece according to said calculations;

e) calculating the location of a feeding point and providing feeding line connected to the feeding point;

f) choosing a shell and a metal foil attached to the shell corresponding to the impedance matching space;

g) installing the antenna to the shell and making the impedance matching element contacting with the metal foil.

15. The method of modulating impedance matching of an inverted-F antenna as claimed in claim 14, wherein the radiating element comprises a first radiating section extending in a longitudinal direction, a second radiating section extending in a opposite direction to the first radiating section, and a third radiating section, and wherein the first radiating section and the second radiating section are connected at a first site, the third radiating section connects to the impedance matching element at a second site.

16. The method of modulating impedance matching of an inverted-F antenna as claimed in claim 15, wherein the impedance matching element comprises a first connecting section connecting to the second site, a third connecting section connecting to the grounding element parallel to the first connecting section, and a second connecting section connecting the first connecting section and the third connecting section.

17. The method of modulating impedance matching of an inverted-F antenna as claimed in claim 16, wherein the first connecting section, the second connecting section, and the third connecting section together formed an impedance matching space.

18. The method of modulating impedance matching of an inverted-F antenna as claimed in claim 17, wherein the impedance matching element is of a lying U shape, the metal foil is attached to the impedance matching space.

19. An antenna comprising:

a radiating element comprising a first radiating section;

a grounding element spaced from the radiating element;

an impedance matching element connected between the radiating element and the grounding element;

a feeder cable connected to the impedance matching element;

a metallic shell positioned beside the impedance matching element and connected to ground; and a metal piece being discrete from said metallic shell and connected between the metallic shell and the impedance matching element; wherein a character or a dimension of said metal piece is selected to modulate the impedance matching of the antenna.

20. The antenna as claimed in claim 19, wherein said metal piece is a metal foil.

* * * * *